US007530705B2

(12) United States Patent
Czech et al.

(10) Patent No.: US 7,530,705 B2
(45) Date of Patent: May 12, 2009

(54) ROTATABLE LAMP WITH BRAKING MECHANISM

(75) Inventors: Ken Czech, North Dartmouth, MA (US); Richard Meyer, Providence, RI (US); Thomas Gamache, Fall River, MA (US); James Neeld, Tiverton, RI (US)

(73) Assignee: Genlyte Thomas Group LLC, Louisville, KY (US)

( * ) Notice: Subject to any disclaimer, the term of this patent is extended or adjusted under 35 U.S.C. 154(b) by 0 days.

(21) Appl. No.: 11/941,624

(22) Filed: Nov. 16, 2007

(65) Prior Publication Data

US 2008/0062693 A1 Mar. 13, 2008

Related U.S. Application Data

(62) Division of application No. 11/188,292, filed on Jul. 22, 2005.

(51) Int. Cl.
*F21S 8/00* (2006.01)

(52) U.S. Cl. ..... 362/147; 362/269; 362/287; 362/365; 362/427; 248/288.11; 248/343

(58) Field of Classification Search ..... 362/147–148, 362/150, 269, 282, 284–285, 287–288, 364–365, 362/370, 427; 248/289.11, 342–344; 403/349–353
See application file for complete search history.

(56) References Cited

U.S. PATENT DOCUMENTS

| | | | |
|---|---|---|---|
| 394,680 | A | 10/1888 | Dawes |
| 393,126 | A | 11/1888 | Smart |
| 684,264 | A | 10/1901 | Kemmerer |
| 866,473 | A | 9/1907 | Keefe et al. |
| 1,127,527 | A | 2/1915 | Schoen |
| 1,137,906 | A | 5/1915 | Rosenberg |
| 1,501,524 | A | 7/1924 | Cousins |
| 1,631,488 | A | 6/1927 | Jones |
| 1,662,568 | A | 3/1928 | Foell |
| 1,704,626 | A | 3/1929 | Nero |
| 2,518,936 | A | 8/1950 | Roberts |
| 2,554,258 | A | 5/1951 | Lundquist |
| 2,639,368 | A | 5/1953 | Pryne |
| 2,647,202 | A | 7/1953 | Elmer |
| 2,716,185 | A | 8/1955 | Burliuk et al. |
| 2,739,226 | A | 3/1956 | Rex |
| 2,753,445 | A | 7/1956 | Thomas et al. |
| 2,757,818 | A | 8/1956 | Chanberlain |

(Continued)

*Primary Examiner*—Sandra L O'Shea
*Assistant Examiner*—Jason Moon Han
(74) *Attorney, Agent, or Firm*—James E. Cole

(57) ABSTRACT

A recessed light fixture having a rotation ring allowing rotation of a lamp mounted over the fixture frame aperture, the rotation ring easily rotatable on the frame and held in place by a ring clamp. The recessed light fixture rotation ring has a mechanical brake for locking the ring in place after positioning of the lamp. The ring also has a slip disc positioned between the surface of the frame and the ring to allow easy rotation. The housing of the fixture has junction boxes mounted on side walls which are hinged to the sidewalls of the housing and which swivel into the interior of the housing for ready access after installation through the aperture of the frame. The lamp of the fixture movable about a horizontal adjustment and vertical adjustment axis while also maintaining position with respect to the reflector.

13 Claims, 15 Drawing Sheets

U.S. PATENT DOCUMENTS 2,762,598 A 9/1956 Runge
2,802,933 A 8/1957 Broadwin
2,842,281 A 7/1958 Chisholm
2,922,030 A 1/1960 Bobrick
2,937,841 A 5/1960 Bodian
2,965,348 A 12/1960 Gerstel et al.
3,057,993 A 10/1962 Gellert
3,082,023 A 3/1963 Rudolph et al.
3,168,252 A 2/1965 Cagernoch
3,182,187 A 5/1965 Gellert
3,313,931 A 4/1967 Klugman
3,381,123 A 4/1968 Docimo
3,420,995 A 1/1969 Dunckel
3,512,743 A 5/1970 Lipscomb
3,518,420 A 6/1970 Kripp
3,590,241 A 6/1971 Docimo et al.
3,609,346 A 9/1971 Lund et al.
3,683,173 A 8/1972 Guth, Jr.
3,697,742 A 10/1972 Bobrick
3,700,885 A 10/1972 Bobrick
3,749,873 A 7/1973 Harper et al.
3,778,609 A 12/1973 Ligerman
3,872,296 A 3/1975 Cohen et al.
4,039,822 A 8/1977 Chan et al.
4,086,480 A 4/1978 Lahm
4,142,227 A 2/1979 Aikens
4,232,361 A 11/1980 Kelsall
4,250,540 A 2/1981 Kristofek
4,274,615 A 6/1981 Chan et al.
4,293,895 A 10/1981 Kristofek
4,318,161 A 3/1982 Shanks
4,318,162 A 3/1982 Sip
4,336,575 A 6/1982 Gilman
4,382,274 A 5/1983 De Backer et al.
4,408,262 A 10/1983 Kusmer
4,414,617 A 11/1983 Galindo
4,431,151 A 2/1984 Schonasky
4,437,142 A 3/1984 Donato et al.
4,459,648 A 7/1984 Ullman
4,471,416 A 9/1984 Druffel
4,473,873 A 9/1984 Quiogue
4,475,147 A 10/1984 Kristofek
4,510,559 A 4/1985 Kristofek
4,605,816 A 8/1986 Jorgensen et al.
4,623,956 A 11/1986 Conti
4,646,212 A 2/1987 Florence
4,704,664 A 11/1987 McNair
4,729,080 A 3/1988 Fremont et al.
4,733,339 A 3/1988 Kelsall
4,745,533 A 5/1988 Smerz
4,751,624 A 6/1988 Russo et al.
4,751,627 A 6/1988 Usher
4,754,377 A 6/1988 Wenman
4,829,410 A 5/1989 Patel
4,887,196 A 12/1989 Brown et al.
5,045,985 A 9/1991 Russo et al.
5,068,772 A 11/1991 Shapiro et al.
5,122,944 A 6/1992 Webb
5,124,901 A 6/1992 Sojka et al.
5,130,914 A 7/1992 Bengochea
5,140,507 A 8/1992 Harwood
5,222,800 A 6/1993 Chan et al.
5,291,381 A 3/1994 Price
5,314,148 A 5/1994 Jones
5,317,493 A 5/1994 Muller et al.
5,325,281 A 6/1994 Harwood
5,373,431 A 12/1994 Hayman et al.
5,377,088 A 12/1994 Lecluze
5,452,193 A 9/1995 Hinnefeld et al.
5,457,617 A 10/1995 Chan et al.
5,538,214 A 7/1996 Sinila
5,556,188 A 9/1996 Poppenheimer
5,562,343 A 10/1996 Chan et al.
5,564,815 A 10/1996 Litman et al.
5,567,041 A 10/1996 Slocum
5,609,414 A 3/1997 Caluori
5,630,663 A 5/1997 Ling et al.
5,669,324 A 9/1997 Muir, III
5,672,004 A 9/1997 Schmidt, Jr.
5,738,436 A 4/1998 Cummings et al.
5,758,959 A 6/1998 Sieczkowski
5,800,050 A 9/1998 Leadford
5,823,664 A 10/1998 Demshki, Jr. et al.
5,826,970 A 10/1998 Keller et al.
5,857,766 A 1/1999 Sieczkowski
5,941,625 A 8/1999 Morand
5,951,151 A 9/1999 Doubeck et al.
6,079,852 A 6/2000 Kamaya et al.
6,113,245 A 9/2000 Reinert, Sr.
6,132,245 A 10/2000 Wetz et al.
6,142,439 A 11/2000 Aramaki
6,145,798 A 11/2000 Janisse et al.
6,220,728 B1 4/2001 Andrus et al.
6,234,644 B1 5/2001 Kotovsky et al.
6,270,238 B1 8/2001 Mendelsohn et al.
6,343,873 B1 2/2002 Eberhard et al.
6,364,510 B1 4/2002 Bernhart et al.
6,375,338 B1 4/2002 Cummings et al.
6,431,723 B1 8/2002 Schubert et al.
6,471,374 B1 * 10/2002 Thomas et al. ..... 362/285
6,505,960 B2 1/2003 Schubert et al.
7,118,254 B2 10/2006 Czech
7,234,674 B2 6/2007 Rippel et al.

* cited by examiner

ROTATABLE LAMP WITH BRAKING MECHANISM

CROSS-REFERENCE TO RELATED APPLICATION

This application under 35 USC § 120 claims priority to, and benefit from, U.S. application Ser. No. 11/188,292, filed on Jul. 22, 2005, entitled "Recessed Fixture with Hinged Doors and Rotatable Lamp," which is currently pending, naming the above-listed individuals as co-inventors.

BACKGROUND OF THE INVENTION

The present invention is related to a recessed light fixture which is rotatably adjustable in order to mount a lamp for directing light downwardly or at an angle relative to the vertical axis as well as to a housing structure allowing easy access to the junction boxes after installation of the recessed light fixture.

Various recessed light fixtures are known to allow mounting of the fixture above the ceiling while also providing for rotational adjustment of the light fixture in combination with pivoting of the light fixture about a horizontal axis. See for example U.S. Pat. No. 5,562,343 which allows for rotation of the lamp about a vertical axis up to about 355° while also allowing providing a vertical pivoting mechanism which allows pivoting from about 0° to 45° vertical tilt of the lamp within the lamp holder assembly. These systems allow rotation of the lamp about the horizontal and vertical axis in order that the user may align a light to user defined and required applications.

It is frequently the case while allowing rotation about a vertical axis to prevent continued rotation beyond 360° in order to prevent damage to the electrical wires. Such rotational stop mechanisms typically restrict rotation of the lamp and tilt assembly to something less than 360° as the various stationary stop abutments must be taken into account when measuring the rotational deflection. This rotational deflection or reduction, which must be taken into account, is typically the thickness of the engagement mechanisms preventing rotation beyond usually about 355°.

In most recessed light fixtures, it is additionally standard to enclose the light fixture with a rigid housing assembly, the rigid housing assembly having junction boxes affixed thereto for wiring connections and other electronic components. The standard housing designs and junction boxes typically have very restricted or limited access to them after installation, thereby preventing wiring modifications once the recessed light fixture is installed about the ceiling.

Additional prior art light fixtures fail to incorporate the ability to vertically adjust the position of the lamp relative to the luminaire fixture pan or frame thereby keeping the lamp in the same stationary position relative to the pan and not allowing for vertical adjustment therewith. This may be undesirable in instances wherein the various tilt of the lamp about a horizontal axis causes the lamp to be cut off due to the trim or reflector placement or with regards to thick ceiling applications.

Additionally, most prior art devices which allow for rotation of the lamp holder about a vertical axis, do not provide for a smooth rotational surface to provide an easy rotation of the lamp relative to the fixture pan due to the metal to metal contact of the various surfaces and mechanical structures involved.

It is therefore desirable to provide a recessed light fixture which has components and mechanical structures which overcome these drawbacks and limitations of prior art constructions.

SUMMARY OF THE INVENTION

The present invention relates to a recessed light fixture which has a frame or pan, the frame or pan having an aperture therein, the pan supporting a rotatable lamp holder mechanism allowing adjustment and rotation of the lamp about the vertical axis while also allowing rotation of the lamp about a horizontal axis. The lamp holder mechanism is retained onto the pan by virtue of first and second support legs which are held in place on a rotation ring. The rotation ring allowing rotation of the lamp about the vertical axis up to about 364°.

Another aspect of the present invention is a rotation ring which is held in place in between a ring clamp and the top surface of the fixture pan, the rotation ring supporting the lamp holder mechanism and captured in between a ring clamp and a smooth slip disk allowing easy rotation about the vertical axis.

Another aspect of the present invention allows for vertical repositioning of the lamp holder mechanism by virtue of first and second slid tab locking mechanisms which engage the first and second legs of the lamp holder mechanism thereby allowing the lamp and trim ring to be adjusted in various vertical positions relative to the pan of the luminaire.

An even further aspect of the present invention is related to the braking mechanism wherein the rotation ring, while allowing rotation beyond 360°, allows for the rotation ring to be locked into place preventing drift of the rotation ring and lamp about a vertical axis by engaging a brake mounted on the rotation ring contacting the surface of the pan or other structure and thereby preventing additional rotation about the vertical axis. The brake may be engaged by access through the aperture after installation of the fixture and positioning in both the horizontal and vertical directions.

An even further object of the present invention is the luminaire housing wherein the luminaire housing has more than one junction box, each of the junction boxes accessible through the aperture in the pan after installation into the ceiling. The junction boxes may be readily accessible from the interior of the pan by virtue of being mounted on hinges wherein each of the junction boxes swings inwardly into the interior of the housing over the aperture and is thereby accessible through the aperture after installation. Such access to the interior of the pan, after installation, prevents the necessity of removal of the entire fixture for electrical modification or changes. A wiring junction box and a transformer junction box may be directly accessible and may be swiveled into the interior of the pan, over the pan or frame aperture, to allow for maintenance access since each have a hinge on a first side allowing it to be swiveled or rotated inwardly into the interior of the housing.

An even further aspect of the present invention is a removable transformer plate in combination with a hinged transformer junction box such that the transformer plate, once installed, containing the transformer, may be removed easily from the interior of the housing after installation of the luminaire above the ceiling. The transformer junction box may be accessed through the aperture in the pan and in the ceiling, the transformer junction box swiveled into the interior of the housing and the transformer plate with the transformer mounted thereon may be readily removed and exchanged with a replacement transformer. All wiring and necessary access is available from the interior of the housing through the aperture in the pan and the ceiling thereby allowing modification of the electrical components and change out as necessary after installation.

An even further aspect of the present invention is a rotatable stop mechanism which has limited rotation and which is mounted onto a stationary ring clamp thereby allowing for rotation of the rotation ring beyond 360° due to an outwardly extending tab positioned on the rotation ring. The rotatable stop mechanism contacts upwardly extending lances or abutments on either side thereby preventing or restricting additional rotation and allowing rotation of the rotation ring and thereby the lamp beyond 360° as may be necessary.

The lamp holder mechanism of the present invention has an annular socket holder ring for retention of the lamp. The lamp holder mechanism has a first and second upwardly extending legs which are ladder like and which have a plurality of notches formed therein for receiving leg retention tabs which are inserted through slidable leg holders or slidable tabs thereby engaging each leg and positioning the lamp in the requisite vertical position relative to the pan. Thus, after installation, the lamp may be adjusted in a rotational position anywhere between about 0° and 364° while also being adjustable along a horizontal axis anywhere from 0° to 45°. Finally, the entire lamp holder mechanism and assembly may be adjusted along the vertical axis and retained therewith by virtue of the slide tabs which engage the first and second legs of the lamp holder mechanism.

DETAILED DESCRIPTION OF THE PREFERRED EMBODIMENT

Figure 11:
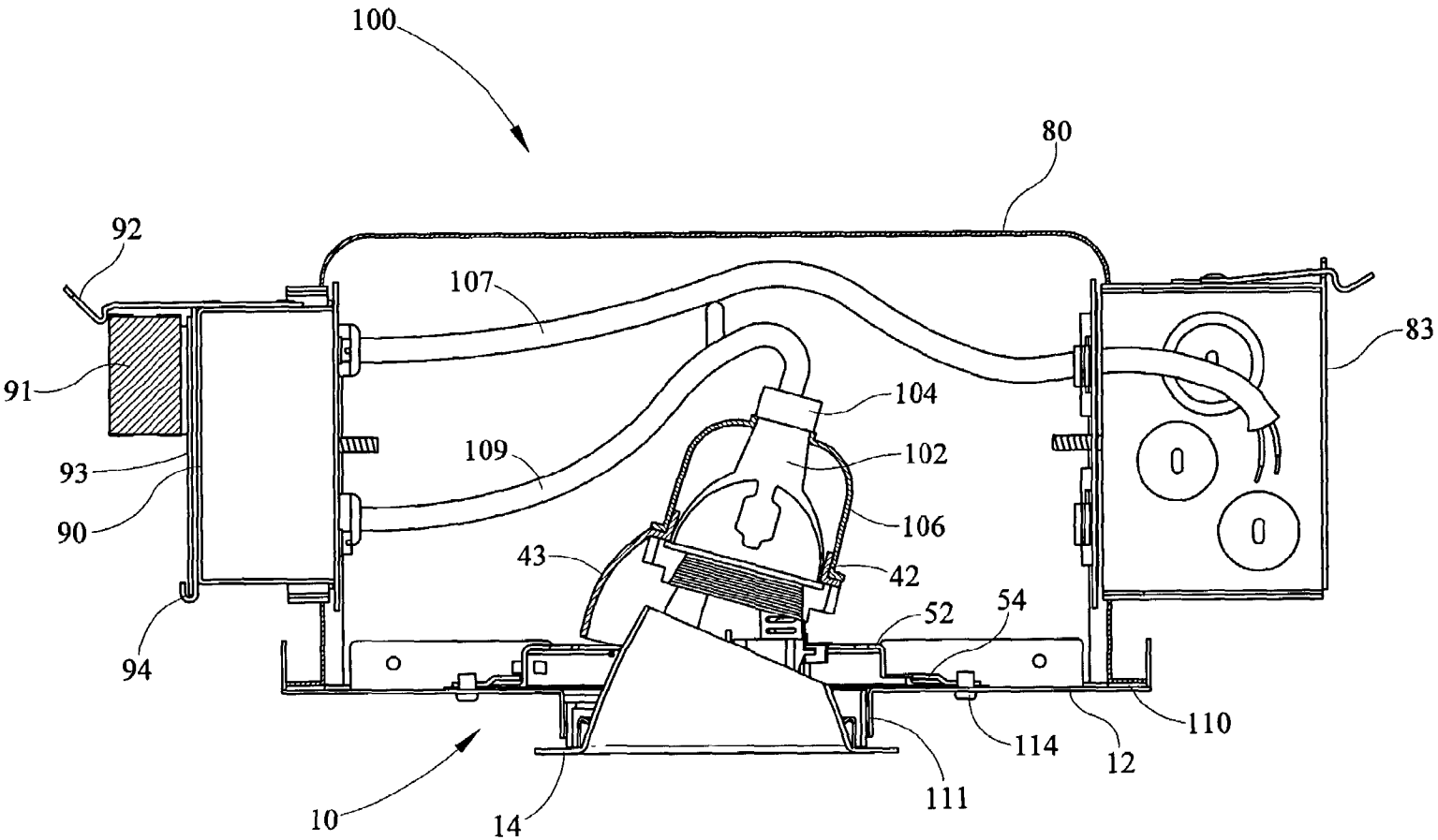
In FIG. 11 is a side sectional view of the fully assembled recessed fixture with hinged door and rotatable lamp of the present invention.

The recessed fixture with a hinged door and rotatable lamp is generally shown in the figures. FIG. 11 depicts a side sectional view of the assembled fixture 100 wherein a housing 80 surrounds a lamp and other hardware all mounted on a pan 12 for mounting above a ceiling line. As is understood in the art, an aperture is formed in the ceiling line around the plaster ring 111 after the assembled fixture housing and pan 100 is inserted into the rafters or ceiling line. After installation into the ceiling, the drywall is placed around the plaster ring 111 making access to the assembled fixture 100 much more difficult. Hence, with the design of the present recessed fixture with hinged door and rotatable lamp, after installation and affixation of the fixture 100 behind the ceiling and installation of the ceiling, electrical components as well as mechanical and electrical lamp aspects of the fixture may be readily accessed through the aperture formed in the ceiling and through the plaster ring 111.

Figure 1:
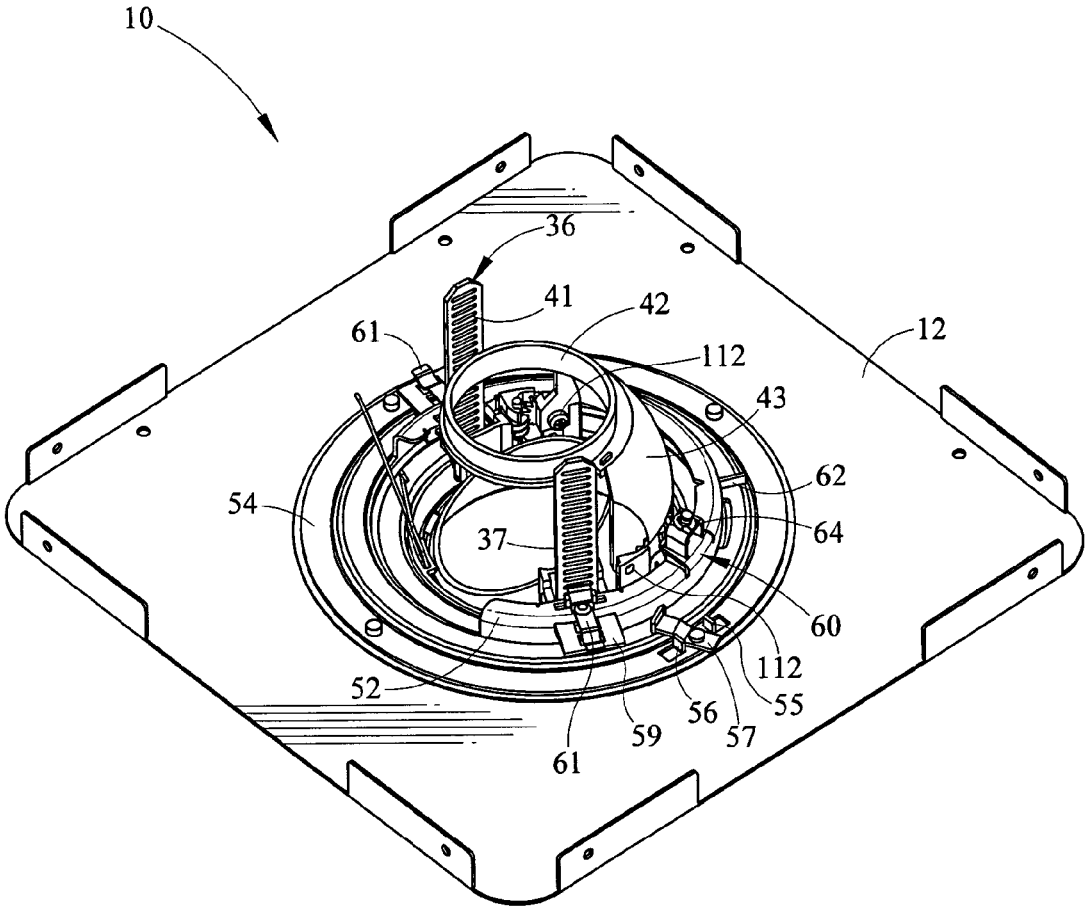
FIG. 1 is an assembled view of the fixture pan and rotatable lamp holder structure of the present invention.

The assembled fixture pan 10, depicted in FIG. 1 and in FIG. 11, is comprised of the pan 12 which allows mounting of the lamp support structure and other mechanisms which allow rotation of the lamp about a vertical axis while also allowing rotation of the lamp about a horizontal axis. Further, the mechanical structure depicted and described herein, allows the lamp to be raised and lowered relative to the pan 12, such that the lamp 102 is placed in either a closer proximity or more distant proximity to the aperture defined by the plaster ring 111.

As is commonly understood, after installation behind the ceiling line and drywall of the ceiling around the aperture formed by plaster ring 111, a trim and reflector piece 14 is inserted into the aperture defined by the plaster ring 111 to provide a finished appearance for the recessed fixture with hinged door and rotatable lamp 100.

Figure 2:
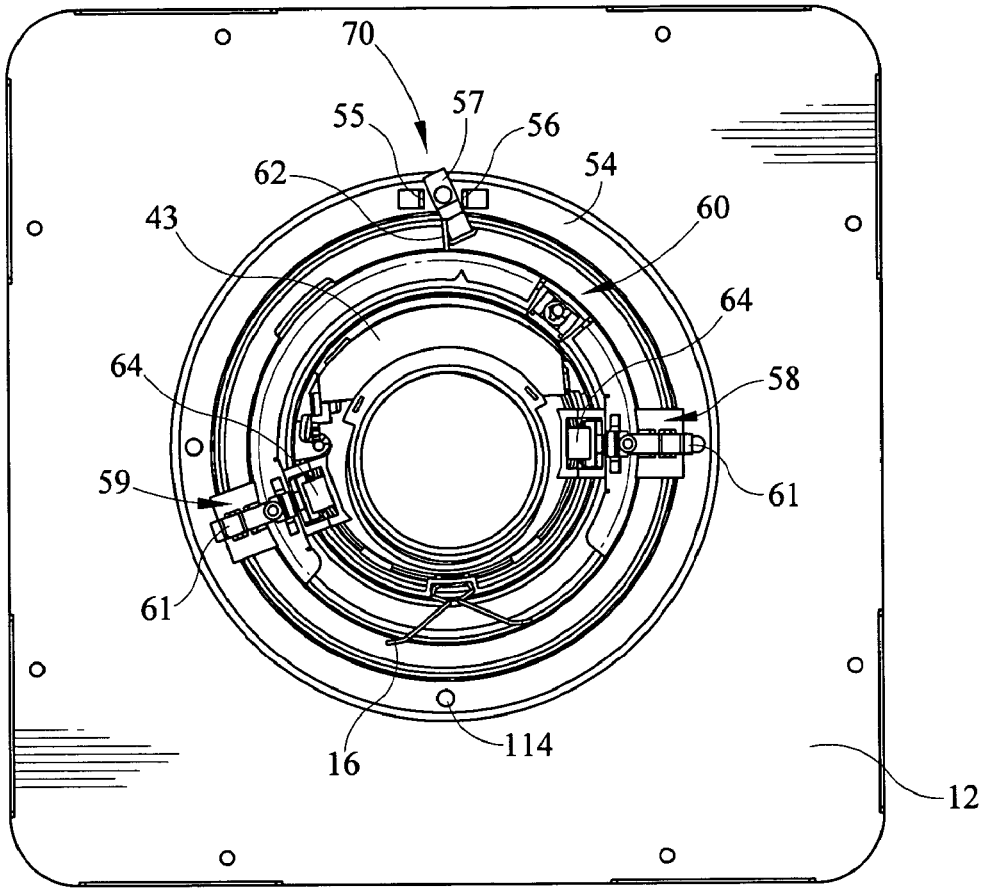
FIG. 2 is a top view of the recessed fixture with rotatable lamp of the present invention in a first rotated position.
Figure 3:
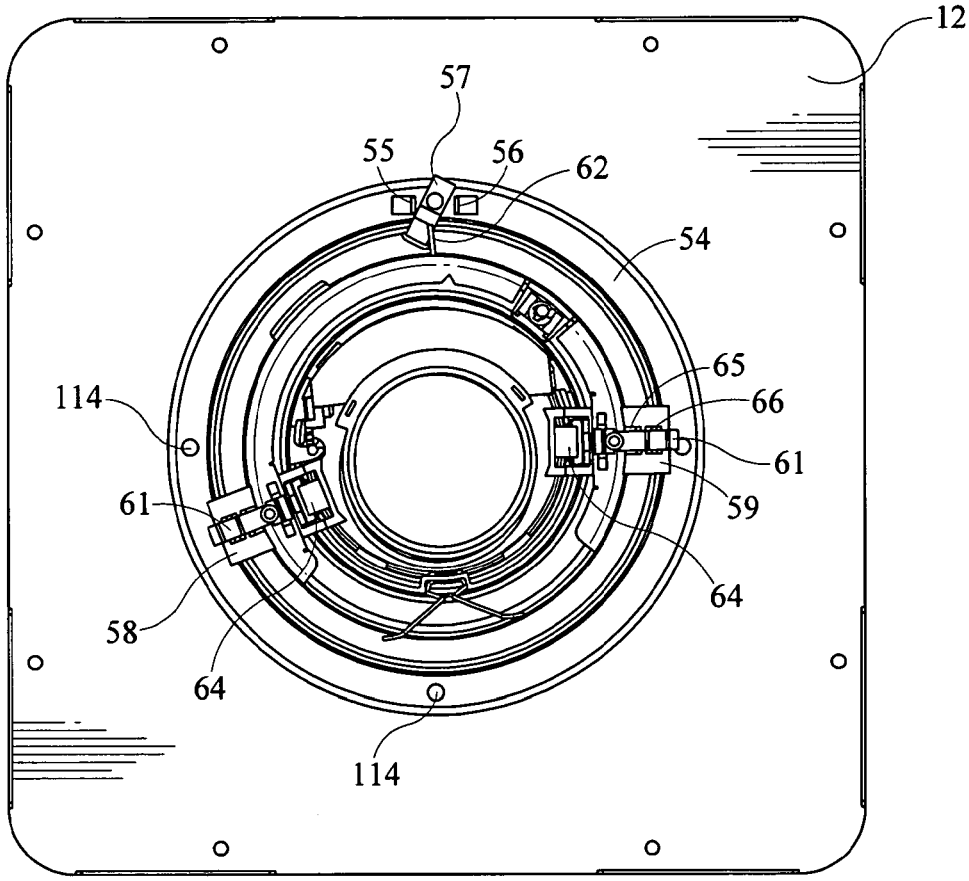
FIG. 3 is a top view of the fixture of FIG. 2 in a second rotatable position.

As can be seen from FIGS. 1-3, the lamp is supported by a annular socket holder 42, the lamp 102 not shown in these figures for clarity but the lamp socket 104 attached to the socket holder by clips or other mechanical attachment. The lamp and the socket holder 42 are constructed such that the socket holder ring 42 may be rotated about a vertical axis extending through the center point of the aperture formed in the pan and defined by the plaster ring 111, the center point of rotation being generally the center point of said aperture in the pan 12 and ceiling. The assembled fixture pan 10 depicted in the figures allows for rotation of a rotation ring 52, the rotation ring attached to the socket holder 42 by the first lamp holder leg 36 and second lamp holder leg 37. The rotation ring 52 allows rotation about said vertical axis to a point beyond 360° due to the rotational stop 57 being moveable and mounted on the ring clamp 54.

Figure 6:
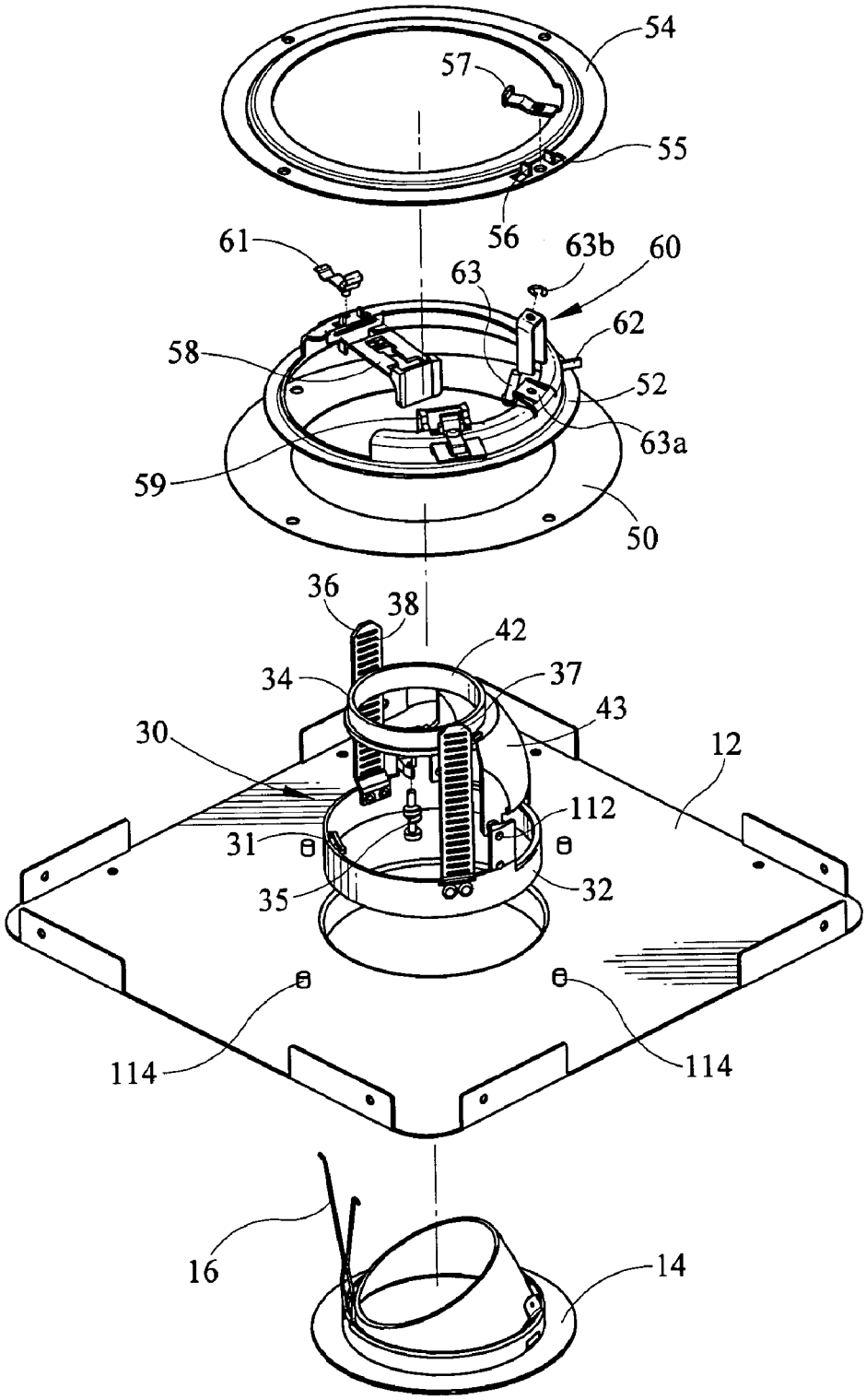
FIG. 6 is an exploded view of the assembly elements of the recessed fixture with rotatable lamp of the present invention.

Additionally, the socket holder 42, correspondingly carrying the lamp 102, may be rotated about a horizontal axis defined by the hinges 112 by virtue of worm gear drive 35 depicted in FIG. 6 and the other figures. Worm gear drive 35, providing the structure for rotation of the lamp and socket holder 42 about the horizontal axis defined by the hinge points 112 is more fully described in co-pending U.S. patent application Ser. No. 11/065,920 filed Feb. 25, 2005, the entire disclosure of which is incorporated herein by reference.

As can be understood, the rotation ring 52 allows the socket holder 42 and corresponding lamp 102 to be rotated about a vertical axis, but only to a limited extent. Continuous rotation about said vertical axis would allow compromising of the electrical connections to the lamp 102. Thus, rotational stop 57, which is mounted to the ring clamp 54, contacts stop tab 62 and allows for 364° rotation, but prevents additional rotation beyond a predefined limit.

The entire assembled fixture pan 10 is then surrounded by the housing 80 which, as shown in FIG. 11, may have transformer junction box 90 on one side and primary junction box 83 on the other side. Lead wire 107 may extend from primary junction box 83 to transformer junction box 90 allowing modification of the power supply to the lamp 102 via line 109 which exits the transformer junction box. The entire assembled housing 100 mounted on the pan or frame 12 is then fully assembled and may be installed behind the ceiling line prior to installation of the ceiling.

Rotation Ring Design

The recessed fixture with hinged doors and rotatable lamp 100 when assembled on the fixture pan or frame as depicted in FIGS. 1-8 has a rotation ring 52 which allows corresponding rotation of the lamp 102 connected to socket holder ring 42. The rotation ring 52, shown in FIG. 6, may have a number of structures implemented thereon for supporting the lamp holder mechanism 30.

The rotation ring 52 has extending outwardly therefrom stop tab 62 which is designed to allow rotation of the rotation ring and hence the lamp about a vertical axis to a limited extent. It is preferable to prevent continuous rotation of said rotation ring due to electrical connections to the lamp. Thus, stop tab 62 extends outwardly from the rotation ring for contacting of a stop member or other device. Rotation less than 360° however, may be undesirable in that upon installation of the assembled fixture 100, fine adjustment and rotation may be necessary at 360° to 364° about said vertical axis. Thus, a moveable rotational stop may be desirable wherein the rotational stop allows continued rotation of the rotation ring 52 beyond 358°.

In the present design, the rotation ring 52 has an outwardly extending stop tab 62 for contacting with a rotational stop 57, the rotational stop 57 extending inwardly and mounted on a ring clamp 54 and separated from the top surface of the pan 12. The rotational stop 57 may rotate to a limited degree when the rotation ring 52 is rotated in both the counter-clockwise and clockwise direction, as is depicted in FIG. 2 and in FIG. 3. The rotational stop 57 is positioned adjacent to upwardly extending first stop tab 55 and a second stop tab 56, each of the stop tabs may be formed in the ring clamp as upwardly extending lamp abutments or other protuberances for limiting or preventing continued rotation of the rotational stop 57. Rotational stop 57 is rotationally mounted to the ring clamp 54 by rivet or other means allowing easy rotation thereof when contacted by outwardly extending stop tab 62.

In the rotation ring 52 of the present design, the rotational stop is mounted on the ring clamp 54 and allows for rotation of the ring and lamp beyond 360°, as is depicted in FIG. 2 and FIG. 3. In FIG. 2, the rotation ring 52 has been rotated in the clockwise direction causing the rotational stop 57 to contact the second stop abutment or lancing 56 thereby preventing continued clockwise rotation of the rotation ring. Conversely, as depicted in FIG. 3, when the rotation ring 52 is rotated in the counter-clockwise direction, stop tab 62 contacts the rotational stop 57 which causes rotational stop 57 to contact first stop abutment or lancing 55 thereby preventing continued counter-clockwise rotation of the rotation ring 52. The rotational stop 57 is separated from the pan 12 and mounted directly on the ring clamp 54 thereby allowing separate assembly and movement of the rotational stop 57 away from the pan 12.

Rotation Ring Assembly

As depicted in FIG. 6, the rotation ring 52 is assembled in a position between a ring clamp 54 and a Teflon washer or slip disc 50. As may be readily understood, it would be undesirable to allow rotation ring 52, which is typically comprised of a metal type material, to rotate directly on the surface of the pan 12. Thus, in the rotation ring assembly of the present design, the rotation ring 52 is mounted in between a ring clamp 54 and the Teflon washer or slip disc 50. The slip disc 50 is mounted directly on the surface of the pan 12 and has a reduced coefficient of friction comparative to the top surface of the pan thereby allowing the smooth rotation of the rotation ring 52 after assembled onto the pan 12. A plurality of rivets 114 may extend upward from the pan and extend through the slip disc 50 in order to retain the slip disc ring clamp in place and rotationally position the rotation ring 52 between the ring clamp 54 and slip disc 50. By positioning the slip disc 50 below the rotation ring 52, rotation of the lamp holder mechanism 30 is readily achieved while also maintaining stability by positioning the ring clamp 54 over the top of rotation ring 52. Thus, after installation and mounting on the top surface of the pan or base plate 12, rivets 114 extend upward through the slip disc 50 and the ring clamp 54. The rotation ring 52 is interposed in between the slip disc 50 and the ring clamp 54 but may readily rotate therein as the outer diameter of the rotation ring 52 is less than the placement of the rivets 114 through the stationary slip disc 50 and the ring clamp 54.

The slip disc 50 may be a Teflon washer or similar material which has a reduced coefficient of friction as compared to the top surface of the pan 12. The slip disc 50, as may be understood, may also be integrated directly into the pan 12 surrounding the aperture formed therein and need not necessarily be a separate washer construct as depicted. It is desirable to merely provide a surface which allows ready rotation of the rotation ring 52 about the aperture formed in the pan or frame 12. Various other structures may be utilized including an integrated slip surface on the top surface of the pan or a depending C-shaped channel extending downward from the ring clamp.

This channel extending from the ring clamp 54 may be utilized within which the rotation ring 52 slides, the channel or groove having a reduced coefficient of friction allowing easy rotation of the rotation ring therein. In such equivalent construct however, the rotation ring 52 has a lower surface which contacts an upper surface having a reduced coefficient of friction thereby allowing for easy rotation of the rotation ring 52 relative to a stationary surface therebelow.

Mechanical Brake

Once positioned in the proper orientation and rotational position, it may be desirable to fix the lamp 102 in place and prevent inadvertent movement or continued rotation caused by biasing of the power cords 107 or 109 or other forces. In order to prevent additional rotation or movement of the rotation ring 52, particularly as a result of the reduced friction of the slip disk 50, and mechanical brake 60 is provided and mounted to the rotation ring 52. As is seen in FIGS. 1-7 and 14-15, the mechanical brake 60 is comprised of a U-shaped brake member extending through an inwardly directed tab on the rotation ring 52. The inverted U-shaped mechanical brake member 60 further has an upwardly extending brake screw 63 extending through the horizontal portion thereof. In the design as shown, the brake screw 63 extends upward through the inwardly directed brake tab 63A and through an aperture in the inverted U-shaped brake member 60. A spring or other biasing device, not shown, may be interposed between the top surface of the brake tab 63A and the bottom surface of the brake member 60, around the screw 63, thereby biasing the U-shaped brake member 60 upward away from the brake tab 63A and the surface of pan 12.

As can be understood, rotation of the brake screw 63 in either direction causes the U-shaped brake member 60 to rise and lower through the brake tab 63A, as both legs of the U-shaped brake member 60 extends through the brake tab 63A on either side of the aperture receiving the brake screw 63. Upon rotation of the brake screw 63, the U-shaped brake member moves upward and downwards clockwise rotation of the brake screw forces the inverted U-shaped brake member 60 downward causing each of the legs to contact the innermost surface of the pan 12 thereby locking the rotation ring 52 in place. Alternatively, counter-clockwise rotation of brake screw releases the brake from such contact and allows rotation of the ring 52.

After installation, the brake screw 63 is readily accessible through the aperture formed in the pan 12 and, as mentioned, the spring positioned between the brake tab 63A and the U-shaped brake member 60 causes the U-shaped brake member to be biased upwardly away from the top surface of the pan. After installation however and positioning of the lamp in the desired location, clockwise rotation of the brake screw compresses the spring between the brake tab 63A and the U-shaped brake member 60 and forces each leg of the brake member downward until it contacts the top surface of the pan thereby locking the rotation ring in position and preventing further rotation. Similarly, unthreading of the brake screw 63 releases the brake from contacting the top surface of the pan 12 and allows rotation and adjustment of the lamp and rotation ring 52.

As shown in FIG. 6, to aid in access of the brake screw 63, the brake screw 63 is angled slightly upwardly and outward from a vertical axis of the center point of the aperture making the head of the brake screw 63 easily accessible. This angle is further aided by a slight upward and inward tilt of the brake tab 63A thereby assuring that the head of the brake screw 63, which is maintained in position directly against a lower surface of the brake tab 63A due to the biasing effects of the spring positioned between the brake tab 63A and the top end of the U-shaped brake member 60 is easily reachable through the aperture. Other means to prevent the brake screw from becoming disengaged from the brake member such as crimping, staking or a nut may also be utilized. Additionally, as shown in FIG. 6, a retaining clip 63B is positioned around the brake screw above the U-shaped brake member 60 in order to retain the brake screw in place and prevent it from dropping out of the aperture in the U-shaped brake member 60. Thus, the retention clip 63B, which may be an E-clip, holds the brake screw 63 in place and provides retention by contacting the threads of the brake screw and prevents the brake screw from falling through the aperture in the U-shaped brake member 60.

By bending the brake tab 63A upward and inward, as depicted in the figures, easy access to the brake screw is maintained and the brake may be implemented readily by turning of the brake screw 63 thereby lowering the U-shaped brake 60 causing the brake to travel downward through the retention apertures in the brake tab 63A and causing the lower end of the legs of the U-shaped brake member 60 to contact the upper surface of the pan 12 thereby preventing further or continued rotation of the rotation ring 52. The vertically traveling brake member 60 contacts the upper surface of the pan and thereby limits additional rotation. The design of the inverted U-shaped brake member 60 further provides two points of contact to stabilize the brake member and minimize the surface area that the force is distributed over thereby reducing the amount of pressure required to completely restrict rotation of the rotation ring.

Lamp Holder Mechanism

Figure 7:
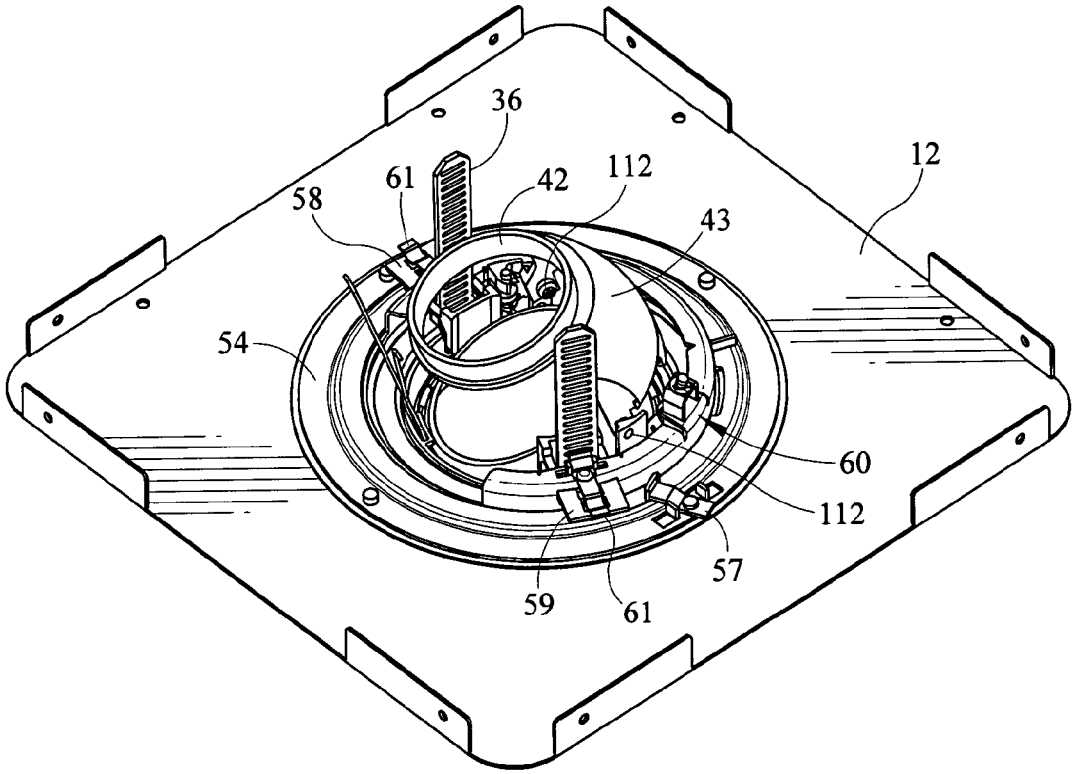
FIG. 7 is an upper perspective view of the recessed fixture with rotatable lamp of the present invention wherein the lamp is rotated about the horizontal axis.
Figure 12:
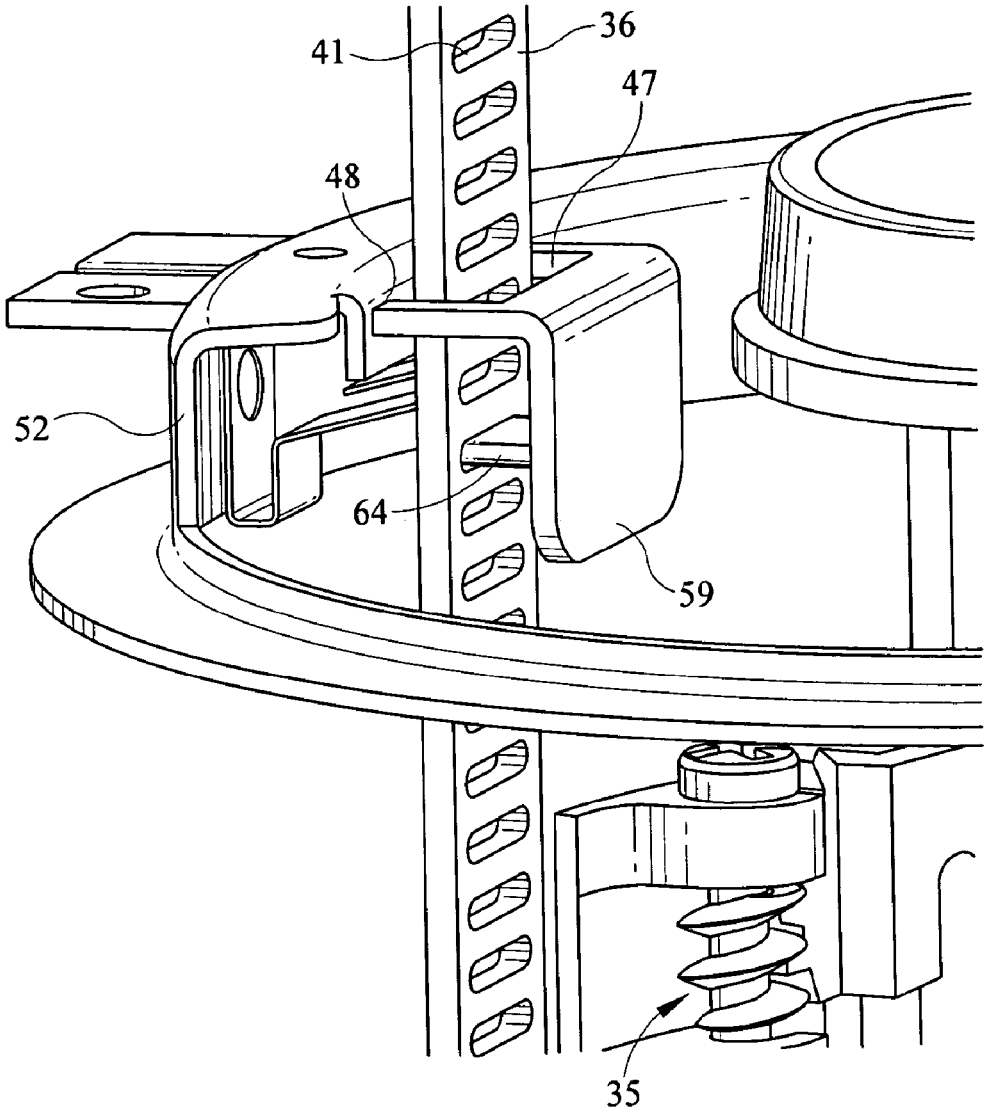
FIG. 12 is a close-up view of the leg holder mechanism of the present invention.
Figure 14:
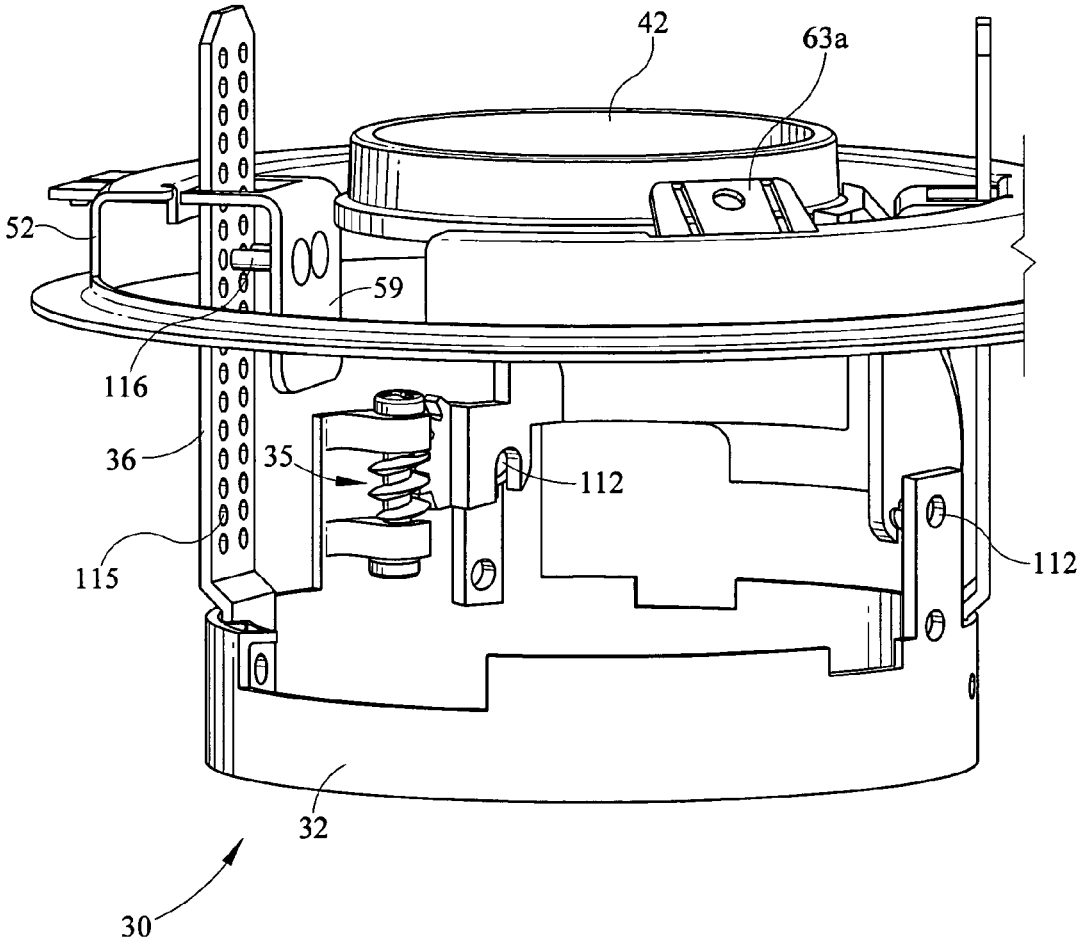
FIG. 14 is a side view of the leg holder mechanism (and other structure) of the present invention.

The lamp holder mechanism 30, particularly shown in FIG. 6 but also shown in FIGS. 1-5 and FIG. 7, retains the lamp 102 and lamp socket 104 in place as well as a lamp enclosure 106, as are shown in FIG. 11. The socket holder 42 which is annular in shape is directly affixed to an upper surface of the aperture shield 43, the aperture shield 43 affixed to hinges 112, the annular socket holder 42 and the aperture shield 43 rotate about the hinges 112 by virtue of the worm gear drive 35. Aperture shield 43 is provided to block the opening into the fixture when the lamp is tilted about the hinges 112. The worm gear drive 35, as previously discussed, is similar in design to that as disclosed in pending U.S. patent application Ser. No. 11/065,920 incorporated herein by reference. In the present design, the worm gear drive 35 contacts a plurality of gear teeth on the lamp holder mechanism 30 formed adjacent to hinge 112, as shown in FIGS. 7, 12, and 14, such that rotation of the worm gear drive 35 forces rotation about a horizontal axis defined by a line costing hinge points 112 depicted in the figures and rotating or tilting the socket holder and aperture shield as depicted in FIG. 7. Rotation of the worm gear drive allows the lamp to be angled in a desired direction. Thus, the lamp may be pointed downward at 0° or may be tilted, as shown in FIG. 7, up to about 45° or more, the rotation occurring about hinge points 112.

The annular socket holder 42, as shown in FIG. 11, is designed to support both the socket 104 and the lamp enclosure 106, as shown in FIG. 11 and also shown in the slightly tilted or rotated position.

The lamp holder mechanism 30 further has upwardly extending first lamp holder leg 36 and upwardly extending second lamp holder leg 37 which extend upward from trim ring 32, the legs 36 and 37 allowing the lamp holder mechanism 30 to be installed into the rotation ring 52 and rotatable therewith. Each of the legs 36, 37 may be ladder type legs having a plurality of notches or apertures 38 formed therein.

In the design of the present invention and the lamp holder mechanism 30, the first and second leg 36 and 37 extend upward and attach to the rotation ring 52 by the first leg holder 58 and second leg holder 59. As can be seen in FIG. 6 and the remaining figures, each of the leg holders 58 and 59 are tabs which slide through slots formed in the rotation ring 52 as clearly shown in FIG. 6 and FIG. 12. Each of the slide tabs or leg holders 58 and 59 slide laterally through the ring 52 and are maintained in position by latch springs 61. Each slide tab may extend through first slot 49 and second slot 48 formed in rotation ring 52 as seen in FIGS. 12 and 14 to provide two points of supporting contact of the tab 59. Vertical adjustment of the lamp holder mechanism 30 is provided further to account for multiple thickness ceilings and varying ceiling conditions. These legs 36, 37 that are depicted may be replaced with any plurality of legs or incorporate similar structural support for raising and lowering the lamp and trim relative to the rotation ring.

Figure 5:
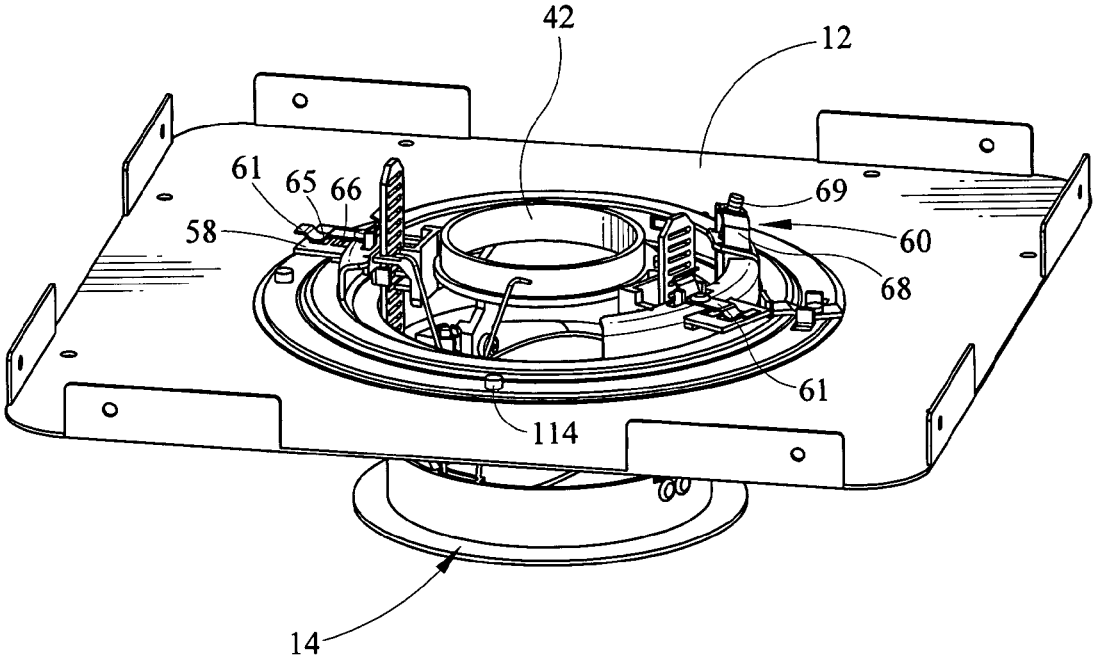
FIG. 5 is a similar perspective view of the recessed fixture with rotatable lamp wherein the lamp holder mechanism is lowered relative to the frame.

First and second slide tabs work in the following manner. Each slide tab 58, 59 slides inwardly relative to the rotation ring 52. When in the full inward position, each of the first and second legs 36, 37 of the lamp holder mechanism 30 extend through the slide tabs aperture 47. By virtue of plurality of notches 41 in each of the legs 36, 37, the lamp holder mechanism 30 may be positioned vertically as desired by the user. Thus, if a thicker ceiling or deeper lamp position is required, the lamp holder mechanism 30 may be in the full up position as shown in FIG. 1. If it is desired to lower the lamp holder mechanism 30 and thus the lamp 102, the lamp holder mechanism 30 may be lowered as shown in FIG. 5. The lamp holder mechanism 30 is held in vertical position by virtue of the leg holders 58, 59 which slide inward such that the leg retention tabs 64, shown in FIGS. 2 and 12, are inserted into a particular aperture or notch 41 in each of the legs.

Thus, to properly vertically install the lamp holder mechanism 30 in the correct position, each of the slide tabs or leg holders 58, 59 are pushed inwardly to open the capturing apertures 47 which receive each of the legs 36, 37. The legs are inserted from the bottom of the pan upward through each of the slide tabs 58, 59 and once in the proper vertical position, each of the slide tabs 58, 59 are pushed outwardly away from the center point of the aperture until the leg retention tabs 64 are inserted into the appropriate notch 41 of the legs 36, 37.

Figure 4:
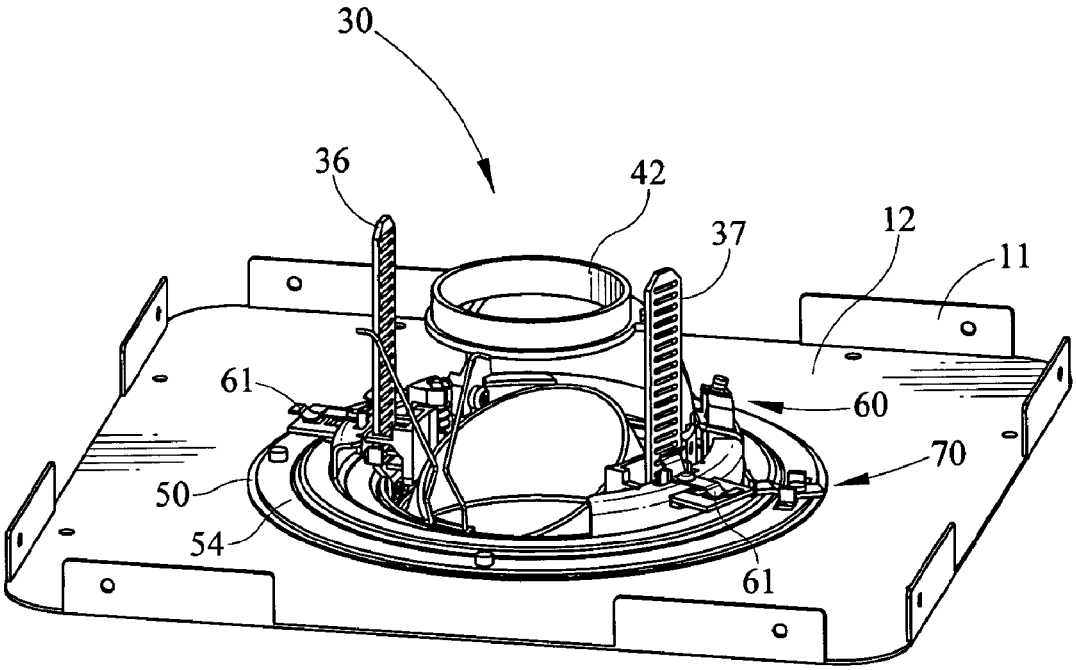
FIG. 4 is an upper perspective assembled view of the recessed fixture with rotatable lamp of the present invention.

As shown in FIG. 2, the leg holders 58 and 59 are in the inward position allowing the legs to be inserted upwardly through each leg holder. As depicted in FIG. 4, each of the legs 36, 37 are in the full upward position, in other words, the lamp holder mechanism 30 is pushed all the way into the recess or aperture of the pan as is depicted in FIG. 11 and FIG. 4. In FIG. 5, the slide tabs have each been pushed inwardly thereby releasing the legs by causing each leg retention tab 64 outward and away from the notches 41 of each leg. After releasing of the legs from the slide tabs with apertures 58, 59 the lamp holder mechanism may be lowered and even removed as necessary for access to the interior of the housing 12.

Further, referring to FIG. 5, the latch spring 61 has a U-shaped groove on the outer edge thereof which fits into a first tab aperture 65 or a second tab aperture 66. First tab aperture is provided to hold the slide tab 58 into position when it is pushed inwardly disengaging from the leg of the lamp holder mechanism 30. Thus, when the slide tab is pushed inwardly, the U-shaped portion of the latch spring 61, shown in FIG. 5, rests in the first tab aperture 65 maintaining the slide tab in disengaged position. Alternatively, when the slide tab 58 is pushed outwardly from the center point of the aperture, the retention tab 64 engages or enters into a notch 41 of the leg holder 36 and the slide tab 58 is maintained in such position by the U-shaped portion of the latch spring 61 resting in second tab aperture 66. Each of the slidable tabs 58, 59 have corresponding first and second tab apertures 65, 66 in order to maintain the slide tab in appropriate position, either engaging or disengaging the legs 36, 37 of the lamp holder mechanism 30.

Figure 8:
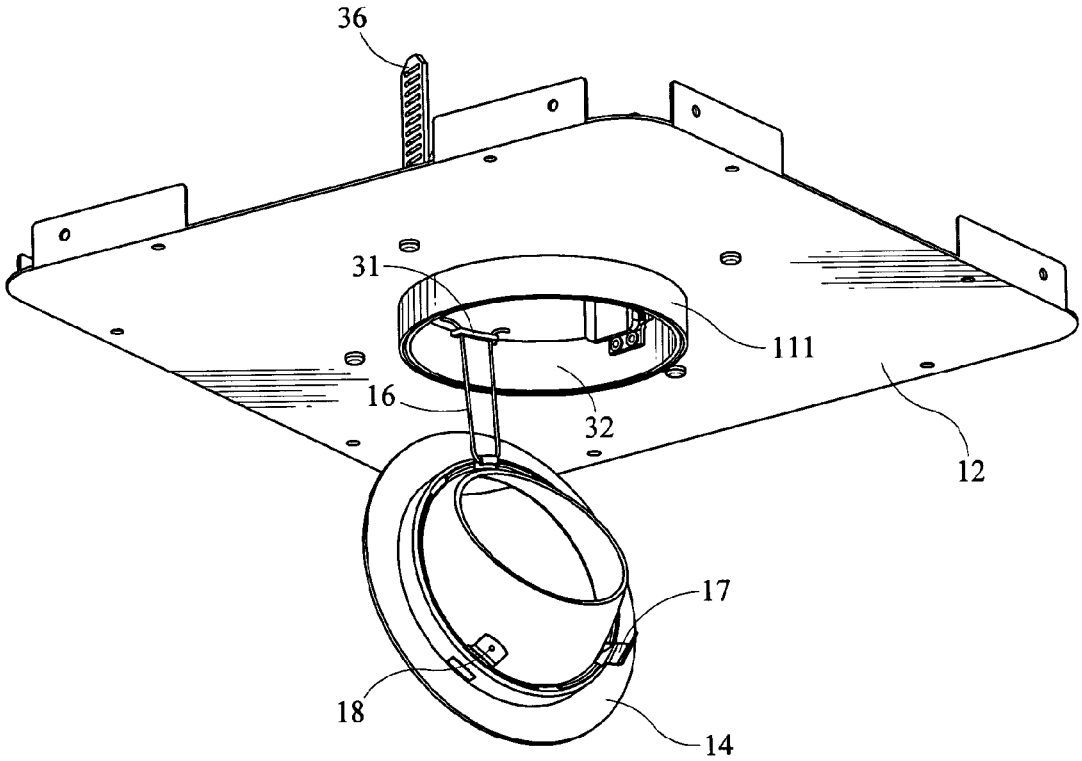
FIG. 8 is a lower perspective view of the recessed fixture with rotatable lamp of the present invention with the trim ring removed and supported by a torsion spring.

The slidable tab design of the present invention utilizes laterally sliding engagement tabs 58, 59 to engage ladder shaped legs of a lamp holder mechanism for raising and lowering the lamp holder mechanism as desired. As shown in FIG. 5 with the lamp holder mechanism 30 in the lowered position, the trim 14 is readily accessible. Upon raising of the trim and lamp holder mechanism 30, each of the slide tabs 58, 59 may be pushed outward from the center point of the aperture formed in the pan 12 in order to lock the lamp legs in the correct position as desired. Alternatively, if access to the interior of the recessed fixture and housing 12 is desired, the lamp holder mechanism 30 may be entirely removed from the rotation ring 52 by pulling inward on each of the tabs toward the interior of the aperture and lowering the lamp holder mechanism 30 until fully removed from the rotation ring 52. After removal of the lamp holder mechanism, the entire interior of the housing and recessed fixture with hinged door and rotatable lamp may be accessed for direct access to electronics or wiring. The lamp itself may be replaced directly from below by lowering the trim 14, as shown in FIG. 8, but does not require removal of the entire lamp holder mechanism 30.

Finally, in regards to the latch springs 61 which are utilized bias or retain the slidable tabs 58, 59, as previously mentioned, the outer portion of each of the latch spring 61 has a U-shaped deflection which rests into one of the apertures 65, 66 formed in the slide tabs 58, 59. At the opposite distal end of the latch spring 61 is an upwardly and inwardly directing biasing portion which engages the corresponding leg as desired. However, this portion of the latch spring may be designed not enter into the interior of the notch or may be slidable therein for easy removal of the legs from the appropriate slide tabs 58, 59. Further, by providing each of the first and second tab apertures 65 and 66, the latch spring 61 may be utilized to lock the slide tab in appropriate position, whether engaging the legs or disengaging the legs, and maintaining such position due to the operable connection between the U-shaped portion of the latch spring 61 and the apertures 65, 66 of the slide tabs 58, 59.

Figure 13:
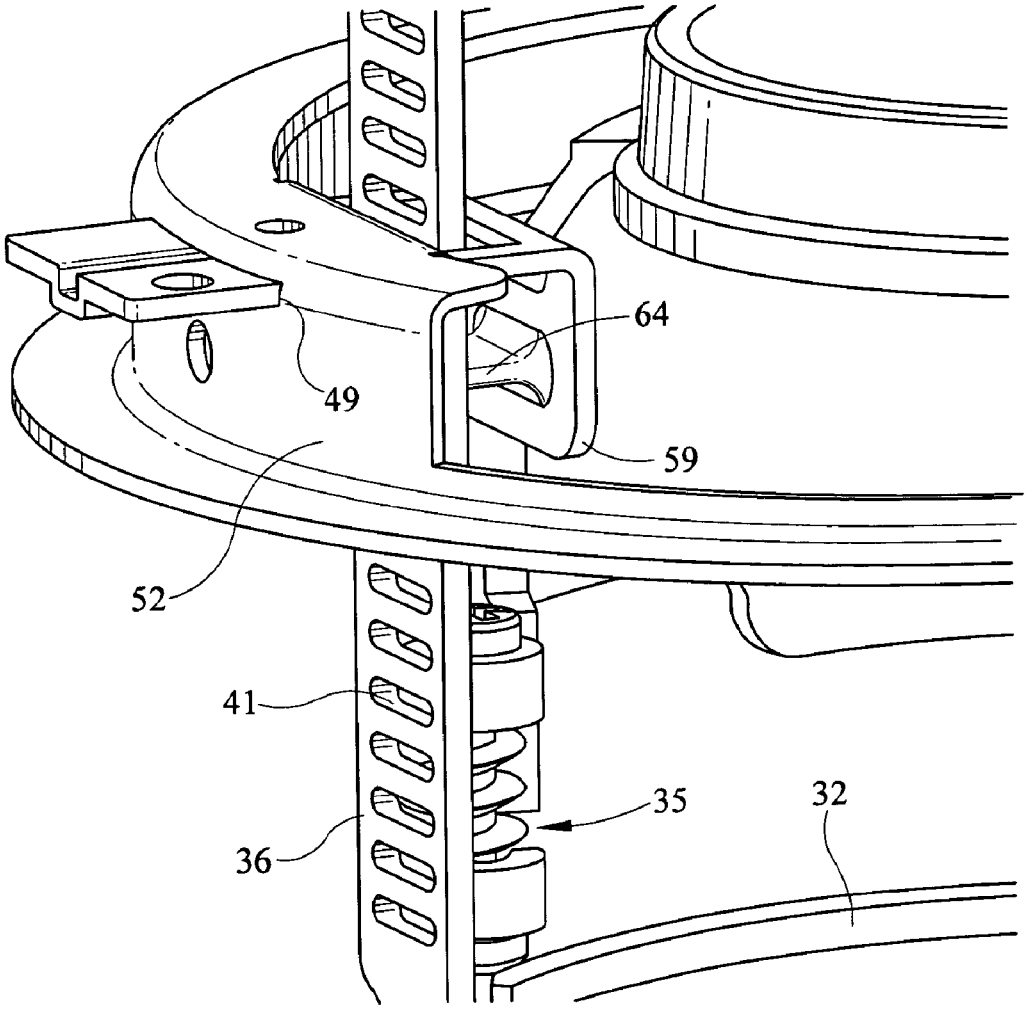
FIG. 13 is an opposite side view of the leg holder mechanism shown in FIG. 12.

Operation of the slide tab 59 is depicted more closely in FIGS. 12 and 13 wherein partial schematics of the rotation ring 52 is depicted. As shown, the slide tab 59 has outwardly directed retention tab 64 for insertion into one of the ladder notches 41 of the leg 36. While the latch spring is not depicted in these figures, nor or the first and second tab apertures 65 and 66, operation of the engagement action of each of the slide tabs is clearly shown such that the retention tabs 64 can be engaged and disengaged from the ladder or leg aperture 41 from each of the legs. As shown, each of the legs extends upward through the slide tab 59 and aperture 47 such that full removal of the lamp holder mechanism 30 may be achieved. Further, the laterally moving slide tabs may engage and disengage apertures or surfaces of the individual legs 36.

Figure 15:
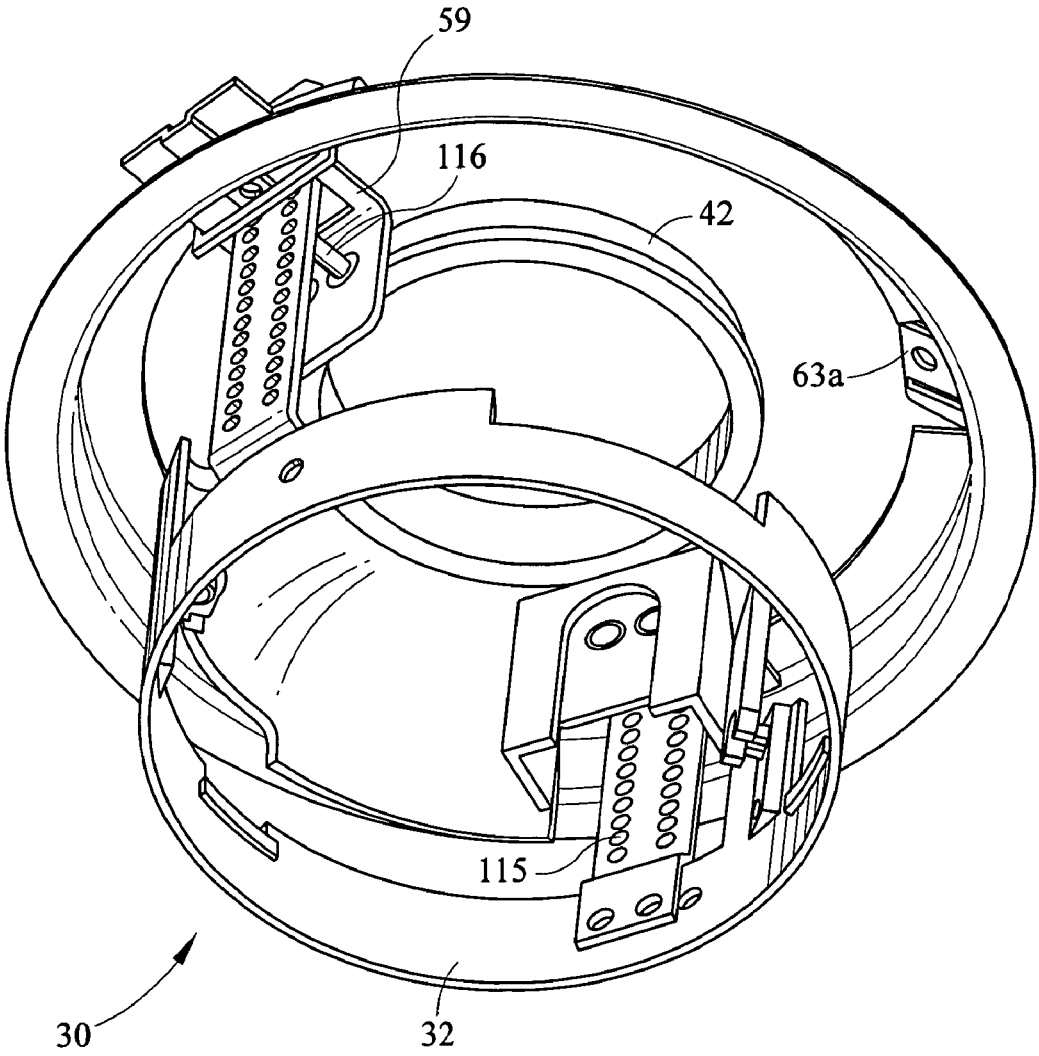
FIG. 15 is a lower view of the trim ring and leg holder mechanism of the present invention.

Alternative construction of each of the individual legs and the engagement with the slide tabs is depicted in FIG. 14. The legs, as opposed to having a plurality of notches 41, have a plurality of apertures 115 which engage posts 116 extended outwardly from the slide tab 59. The apertures and posts may be paired as depicted in FIG. 14 or may be singular as necessary. In such design, posts extend outwardly and through similarly shaped apertures on the leg 36 for engagement therewith and also to maintain position of the socket holder 42 and the entire lamp holder mechanism 30. Similarly, FIG. 15 depicts a lower view of the lamp holder mechanism embodiment shown in FIG. 14 where first and second apertures 115 mate with first and second posts 116 outwardly directed from the slide tab 59. Slide tab 59 moves laterally to engage and disengage the apertures 115 as necessary. The lamp holder mechanism 30 may be engaged and disengaged by the slide tabs 58 and 59 in order to be removed or firmly held in place.

Thus, in these figures, it is seen that the interface between the rotating ring 52 and the legs 36 and 37 of the lamp holding mechanism 30 is such that the lamp holder mechanism 30 may be readily removed or engaged into the rotating ring 52. Further, as is seen in FIGS. 14 and 15, the upwardly extending brake tab 63 extends upward and inward to provide ready access to the brake screw 63. Finally, the worm gear drive 35 for tilting of the aperture shield and socket holder 42 by virtue of turning the worm gear screw 35 such that the socket 104 and lamp 102 tilt about the hinge points 112, is also shown. The ability to maintain the position of the lamp 102 with respect to the top of the opening of the reflector in trip 14 upon vertical movement of the lamp through a vertical adjustment mechanism or through horizontal movement through a horizontal adjustment mechanism significantly improves the optical characteristics of the fixture. Such unitized optics maintains this position of the lamp and top end of the reflector even upon horizontal and vertical movement of the lamp.

Turning to FIG. 8, the trim 14 is retained by a torsion spring 16 held within a spring retainer 31, the spring retainer 31 formed on the trim ring 32. Torsion spring 16 extends through a hinged type member of the trim 14 and is removably inserted into the spring retainer 31 of the trim ring 32. Trim 14 has first and second trim spring tabs 17 and 18 to maintain the trim in bias relationship within the trim ring 32 such that the trim 14 may hang appropriate as depicted in FIG. 8 upon removal of the tabs 17, 18 from biasing against the inner edge or wall of the trim ring 32. Further, the trim 14 may be entirely removed simply by collapsing the torsion spring 16 together allowing the feet of the torsion spring to come through to be removed from the spring retainer aperture 31 on the trim retainer ring.

Hinged Door Design

Figure 9:
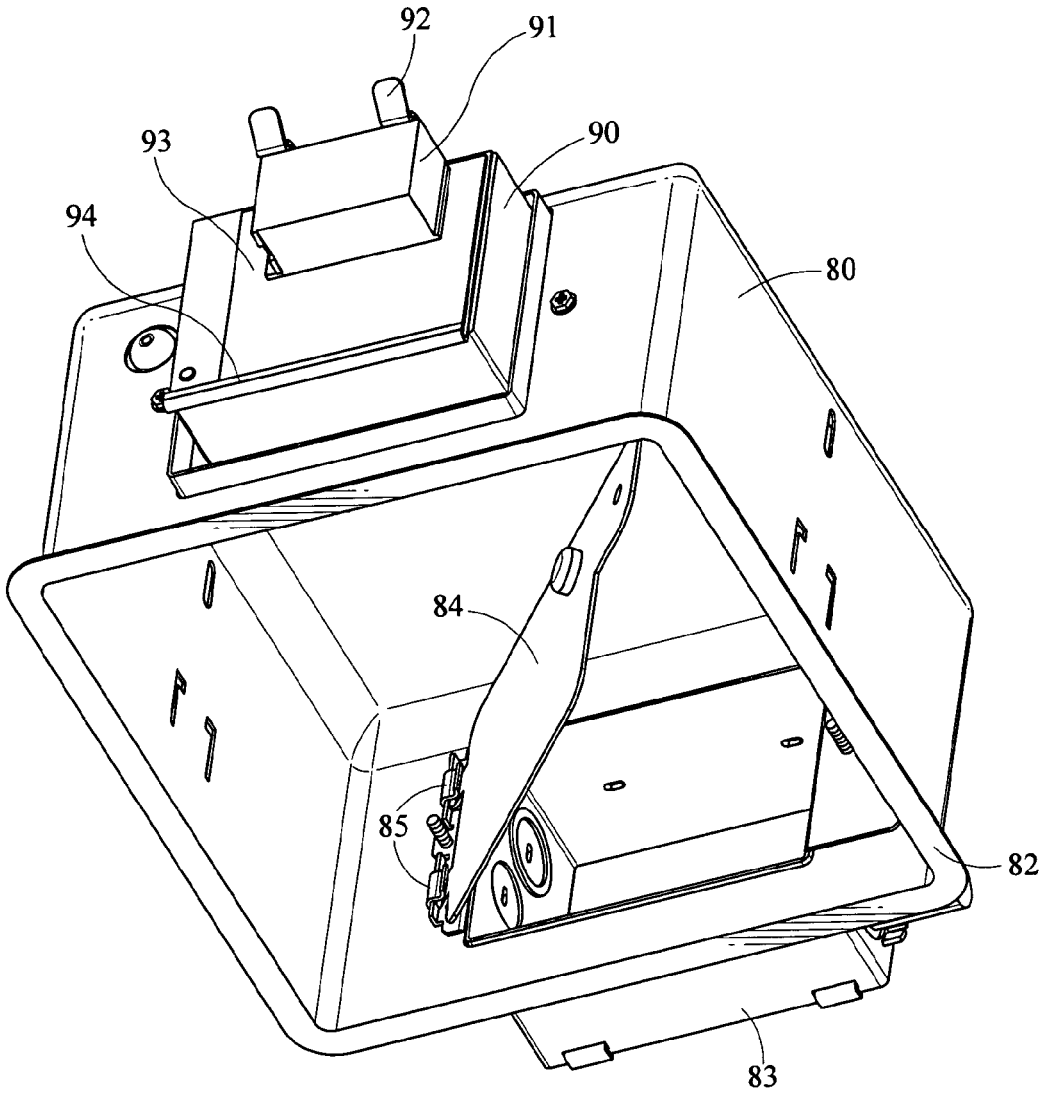
FIG. 9 is a lower perspective view of the housing for use with the recessed fixture with hinged door and rotatable lamp of the present invention.
Figure 10:
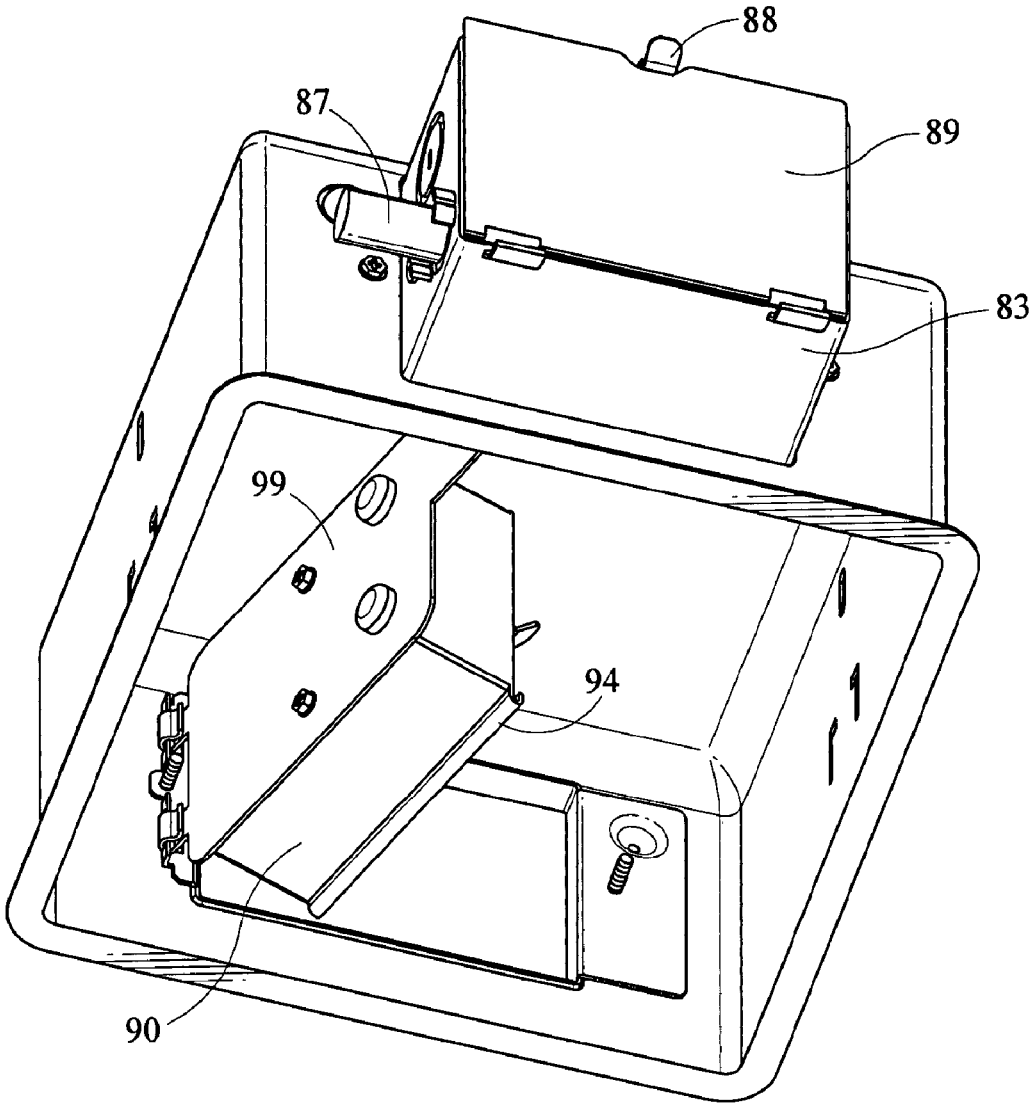
FIG. 10 is a lower perspective view of the opposite side of the housing for use with the recessed fixture with hinged door and rotatable lamp of the present invention.

Turning to FIGS. 9, 10 and 11, the housing 80 is placed on the top of the top surface of the pan 12. The housing 80 has a flange 82 extending outwardly from a bottom edge thereof. Positioned between the flange 82 and the top surface of the pan 12 is a gasket 110 to maintain continuous contact and sealing relationship between the pan and the housing 80 while also preventing dissipation or transfer of heat between the two.

As shown in FIG. 9, the housing 80 has a primary junction box 83 which receives the primary wiring components, while also having a second transformer junction box 90 on the opposite side thereof. After installation on the top surface of the pan 12 and after installation of the entire assembly 100 into the ceiling, as may be readily seen, access to the interior of the primary junction box 83 and the transformer junction box 90 may be problematic due to the limited size of the aperture opening and only having the ability of inserting one hand through the aperture. Thus, when wiring needs to be modified or inspected or a transformer 91 needs replacement, rotation of the transformer junction box 90 about the hinge provides positioning access of the transformer over the aperture. Likewise, the primary junction box 83 may be accessed by rotation of the access door over the aperture in the pan 12.

As shown in FIG. 9, to aid in the access of primary junction box 83, primary junction box door 84 is hinged along a side having hinges 85 such that the primary junction box door 84 may be opened into the interior of the housing 80. Ready access to the interior of the primary junction box and the wiring thereof may have been had by maintenance individuals. Primary junction box door 84 may be held in place in a closed position by wing nuts or other similar type devices. Various types of hinges and position or placement of the hinges on the primary junction box door may also be implemented as long as easy access to the interior of primary junction box 83 may be had and, as indicated, the primary junction box door may swing into the interior of the housing 80.

Further, primary junction box door 84 serves to form a portion of the side wall of the housing 80 where an opening is cut to provide access into the junction box 83. The door 84 hinges or revolves about hinge point 85 over the aperture in the frame 12 such that a hand can reach the wiring therein. After removal of the wing nut retaining the door 84 to the housing side wall, rewiring may then take place. Additionally, the side wall of the housing adjacent the transformer junction box 90 is similarly opened. Thus, the housing 80 is fully enclosed over the frame after closing the doors 84 and 99.

Turning to FIGS. 10, 11, it can be seen that the transformer junction box 90 may also be accessed after installation of the entire assembly 100. Transformer junction box 90 is mounted on a transformer junction box door 99, the door also hinged along hinges 98. Hinges 98 allow the transformer junction box 90 to swing into the interior of the housing 80 over the aperture in the pan. As is seen in combination between FIG. 9 and FIG. 10, by allowing the transformer junction box door 99 to swing interiorly to the housing, ready access to the transformer 91 and removal thereof as necessary may be accomplished. In the design as is depicted, transformer 91 is mounted to a transformer plate 93 which is removable. Transformer plate 93 is held in place by downwardly bias spring tabs 92 pressing on the transformer 91 and forcing a bottom edge of the transformer plate 93 into retention lip 94 of the transformer junction box 90. Various other fastening methods may be utilized to maintain the transformer plate and transformer in place such as threaded wing nuts or a variety of removable or accessible mechanical removable fasteners which are accessible through the aperture. As the transformer needs replacing, the lamp holder mechanism 30 may be removed from the rotation ring thereby providing unfettered accessed to the interior of housing 80. A wing nut or other similar device which retains the transformer junction box door in the closed position may be loosened and the transformer junction box 90 may be swung around about the hinges 98 such that the transformer plate 93 is accessible. Upward deflection of the spring tabs 92 releases the transformer 91 from the biasing effect of the spring tabs and the entire transformer plate, in combination with the transformer 91, may be lifted out of the retention lip 94. Of course, if alternative fastening mechanisms are utilized, the method of removal of the plate 93 or transformer 91 may be altered. Rewiring of a new replacement transformer plate and transformer may then occur such that power line 109 extending out of the transformer junction box 90 and to the lamp may be reattached to the secondary connection of the transformer 91. Power line 107 from the primary junction box 83 leads from primary junction box 83 directly to the primary end of the transformer 91 in order to modify the power supply to the lamp 102.

By providing hinged door access to both junction boxes, namely the primary junction box 83 and the transformer junction 90, maintenance of the electrical components of the assembled fixture 100 may readily occur. The transformer may be replaced and rewired as necessary after installation and after placement behind the ceiling line while also allowing direct ready wiring access to the primary junction box 83 if necessary. All of this access may occur after installation of the fixture 100 behind the ceiling line and without damage to the ceiling. Such access occurs after removal of the lamp holder mechanism 30, lamp 102 and lamp enclosure 106 along with associated structures such that the assembly 30 is removed and the aperture is opened and clear for entry.

Transformer junction box has also, as seen, retention lip 94 which is merely an open channel for receiving a bottom edge of the transformer plate 93 thereby making the transformer plate 93 as well as the transformer 91 directly affixed thereto readily removable from the transformer junction box. Likewise, interior access to the primary junction box and associated wiring as well as the temperature switch and other electronics may be had.

The invention claimed is:

1. A recessed light fixture, comprising:

a rotation ring rotatably mounted on a frame of said recessed light fixture, said rotation ring having a lamp mounted thereon, said rotation ring rotatable within said frame for altering an angle of said lamp, rotation of said rotation ring limited by a stop mechanism;

a mechanical brake affixed to said rotation ring, said mechanical brake traveling substantially vertically through said rotation ring and a lowermost edge of said brake contacting said frame, said mechanical brake incorporating a brake screw, said brake screw threadably extending through said mechanical brake causing said mechanical brake to travel substantially vertically upon rotation of said brake screw.

2. The recessed light fixture of claim 1 wherein said mechanical brake is an inverted U-shaped brake clamp having a first and a second leg and a base portion extending therebetween, said brake screw extending through said base portion and through an inwardly directed brake tab on said rotation ring.

3. The recessed light fixture of claim 2 wherein said brake tab extends upwardly and inwardly from said rotation ring allowing said brake screw to be readily accessible through an aperture formed in said frame.

4. The recessed light fixture of claim 2 wherein said U-shaped brake clamp first and second legs travel vertically through said brake tab and engage said frame about said aperture in order to prevent rotation of said rotation ring.

5. The recessed light fixture of claim 4 wherein said brake mechanism further includes a brake spring interposed between said brake tab and said U-shaped bracket, said brake screw extending through said spring thereby biasing said U-shaped bracket upward away from said frame.

6. A recessed light fixture having a rotation ring affixed to a lamp, comprising:

a brake tab extending inwardly and upwardly from said rotation ring and having an inverted U-shaped brake bracket extending through said brake tab, said U-shaped brake bracket having a first and a second leg, said first and second leg extending vertically through said brake tab, a brake screw extending through said brake tab and said U-shaped brake bracket, said U-shaped brake bracket traveling through said brake tab, said brake screw angled through said brake tab such that it is readily accessible through an aperture in a frame for threading said brake screw through said brake tab and said inverted U-shaped bracket allowing a lowermost edge of said U-shaped bracket to travel up and down to engage and disengage an inner-periphery of said frame and thereby restrict rotational movement of said rotation ring about said frame.

7. The recessed light fixture of claim 6 further comprising a ring clamp positioning said rotation ring on said frame and allowing rotation of said rotation ring between said ring clamp and a top surface of said frame.

8. The recessed light fixture of claim 7 further comprising a slip disk below said rotation ring and above said top surface of said frame, said slip disk, said rotation ring and said ring clamp being annular and positioned around a periphery of said aperture and said frame.

9. The recessed light fixture of claim 7 further comprising a biasing spring surrounding said brake screw and interposed between said brake tab and said U-shaped brake clamp.

10. A recessed light fixture having a rotatable lamp thereon, comprising:

a rotation ring mounted to a lamp, said rotation ring having a braking mechanism vertically movable through said rotation ring by a brake screw for altering an angle of said lamp, said braking mechanism having at least one leg vertically adjustable through an inwardly directed brake tab of said rotation ring;

said at least one leg traveling through said brake tab through rotation of said brake screw and extending through said brake tab and a lowermost edge of said leg engaging a top surface of a frame of said recessed light fixture to prevent rotation of said rotation ring relative to said frame and thereby prevent rotation of said lamp connected to said rotation ring.

11. A recessed light fixture, comprising:

a rotation ring rotatably mounted on a frame, said rotation ring having a lamp mounted thereon, said rotation ring rotatable within said frame, rotation of said rotation ring limited by a stop mechanism;

a mechanical brake affixed to said rotation ring, said mechanical brake traveling substantially vertically through said rotation ring and a lowermost edge of said brake contacting said frame, said mechanical brake incorporating a brake screw, said brake screw threadably extending through said mechanical brake causing said mechanical brake to travel upon rotation of said brake screw;

said mechanical brake being an inverted U-shaped brake clamp having a first leg and a second leg and a base portion extending therebetween, said brake screw extending through said base portion and through an inwardly directed brake tab on said rotation ring;

said U-shaped brake clamp first and second legs travel vertically through said brake tab and engage said frame about said aperture in order to prevent rotation of said rotation ring.

12. A recessed light fixture, comprising:

a rotation ring rotatably mounted on a frame, said rotation ring having a lamp mounted thereon, said rotation ring rotatable within said frame, rotation of said rotation ring limited by a stop mechanism;

a mechanical brake affixed to said rotation ring, said mechanical brake traveling substantially vertically through said rotation ring and a lowermost edge of said brake contacting said frame, said mechanical brake incorporating a brake screw, said brake screw threadably extending through said mechanical brake causing said mechanical brake to travel upon rotation of said brake screw;

said mechanical brake being an inverted U-shaped brake clamp having a first and a second leg and a base portion extending therebetween, said brake screw extending through said base portion and through an inwardly directed brake tab on said rotation ring;

said brake tab extending upwardly and inwardly from said rotation ring allowing said brake screw to be readily accessible through an aperture formed in said frame.

13. A recessed light fixture having a rotation ring affixed to a lamp, comprising:

a brake tab extending inwardly and upwardly from said rotation ring and having an inverted U-shaped brake bracket extending through said brake tab;

said U-shaped brake bracket having a first and a second leg;

said first and second leg extending vertically through said brake tab, a brake screw extending through said brake tab and said U-shaped brake bracket;

said U-shaped brake bracket traveling through said brake tab;

said brake screw angled through said brake tab such that it is readily accessible through an aperture in a frame for threading said brake screw through said brake tab and said inverted U-shaped bracket allowing said U-shaped bracket to travel up and down to engage and disengage an inner-periphery of said frame and thereby restrict rotational movement of said rotation ring about said frame;

a ring clamp positioning said rotation ring on said frame and allowing rotation of said rotation ring between said ring clamp and a top surface of said frame;

a slip disk below said rotation ring and above said top surface of said frame, said slip disk, said rotation ring and said ring clamp being annular and positioned around a periphery of said aperture and said frame.

* * * * *